US005566433A

United States Patent [19]

Love, III et al.

[11] Patent Number: 5,566,433

[45] Date of Patent: Oct. 22, 1996

[54] METHOD AND APPARATUS FOR TREATMENT OF PILE FABRIC

[75] Inventors: Franklin S. Love, III, Columbus, N.C.; Robert S. Brown, Spartanburg, S.C.

[73] Assignee: Milliken Research Corporation, Spartanburg, S.C.

[21] Appl. No.: 436,546

[22] Filed: May 8, 1995

Related U.S. Application Data

[63] Continuation of Ser. No. 3,200, Jan. 11, 1993, abandoned.

[51] Int. Cl.[6] ..... D06C 7/00; D06C 27/00

[52] U.S. Cl. ..... 26/2 R; 28/167; 68/13 R

[58] Field of Search ..... 26/2 R, 27, 106, 26/32, 37, 29 R, 19; 68/8, 13 R, 85, 5 R; 28/159, 167

[56] References Cited

U.S. PATENT DOCUMENTS

| | | | |
|---|---|---|---|
| 322,983 | 7/1885 | Shearer | 26/37 |
| 821,764 | 5/1906 | Strasshoefer | 68/85 |
| 1,880,486 | 10/1932 | Richardson | 26/2 R |
| 1,915,106 | 6/1933 | Shutterworth | 26/2 R |
| 2,283,011 | 5/1942 | Mendelson | 68/85 |
| 2,335,782 | 11/1942 | McMordie et al. | 68/85 |
| 2,590,713 | 3/1952 | Libbey | 26/2 R |
| 2,785,042 | 3/1957 | Grajeck et al. | 26/2 R |
| 3,191,258 | 6/1965 | Spencer | 26/2 R |
| 3,326,711 | 6/1967 | Spencer | 26/2 R |
| 3,589,147 | 6/1971 | Price | 26/2 R |
| 3,644,954 | 2/1972 | LeGrand | 26/2 R |
| 3,739,436 | 6/1973 | Nanjoks et al. | 26/2 R |
| 3,762,870 | 10/1973 | Probst et al. | 68/85 |
| 3,852,980 | 12/1974 | Zimmer | 26/2 R |
| 3,904,793 | 9/1975 | Priester, Jr. | 26/2 R |
| 3,961,115 | 6/1976 | Klein | 26/2 R |
| 4,301,577 | 11/1981 | Mueller et al. | 26/2 R |
| 4,624,023 | 11/1986 | Fleissner | 26/2 R |

FOREIGN PATENT DOCUMENTS

| | | | |
|---|---|---|---|
| 768988 | 1/1971 | Belgium | 26/2 R |

*Primary Examiner*—Amy B. Vanatta
*Attorney, Agent, or Firm*—Kevin M. Kercher; Terry Moyer

[57] ABSTRACT

A method and apparatus for continuous treatment of webs of fabric having upright pile comprised of wetting the fabric to at least 50% saturation, heating the fabric to approximately 225° to 350° Fahrenheit and then brushing the fabric in both the pile and counter-pile directions. The presence of liquid and steam plasticize and lubricate the fibers, thereby allowing an easier, more complete return to the uncrushed state.

18 Claims, 8 Drawing Sheets

*FIG. —4—*

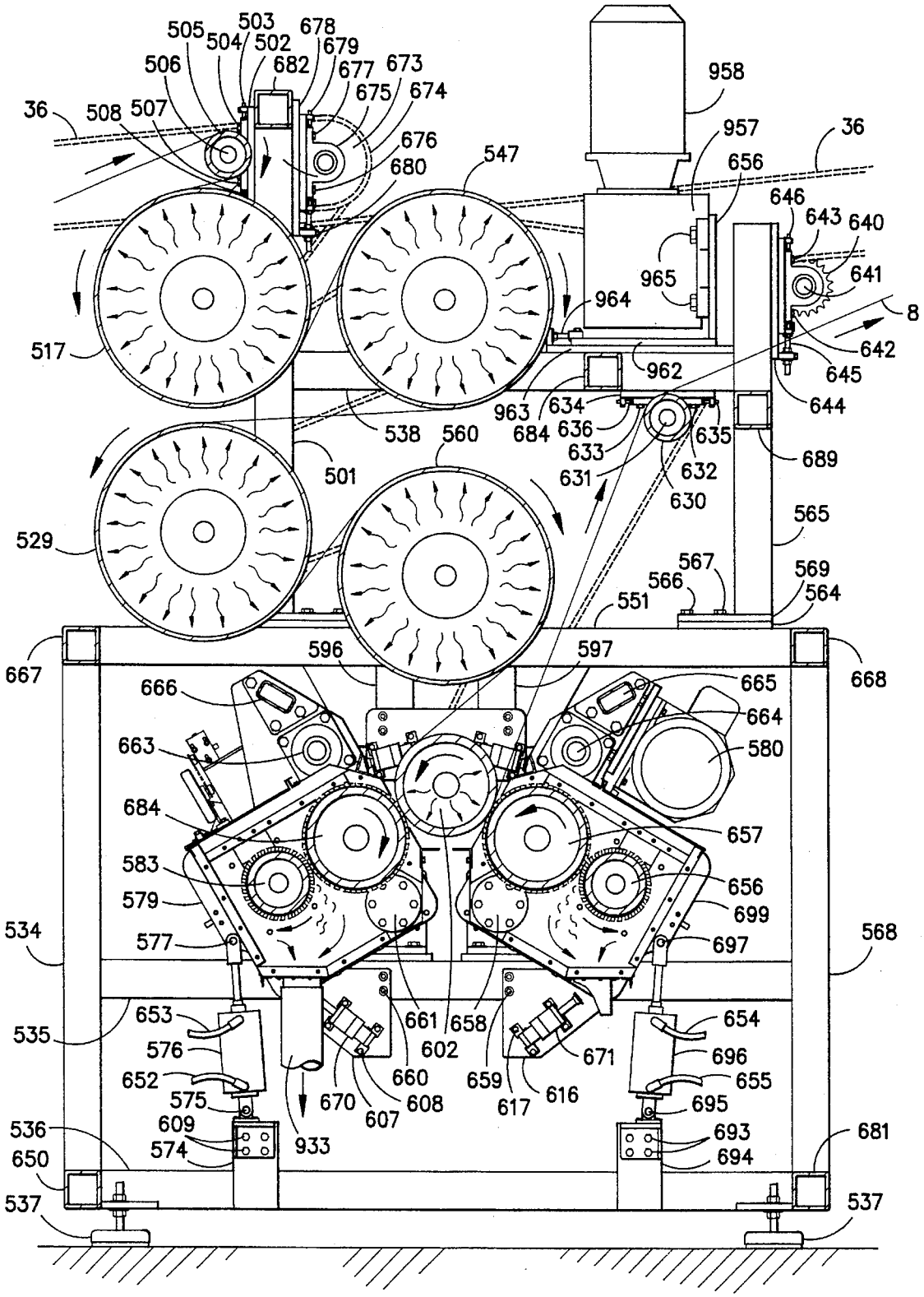
*FIG. –9–*

METHOD AND APPARATUS FOR TREATMENT OF PILE FABRIC

RELATED APPLICATIONS

This application is a continuation of pending prior application Ser. No. 8/003,200, filed Jan. 11, 1993, of Franklin S. Love, III and Robert Saul Brown for METHOD AND APPARATUS FOR TREATMENT OF PILE FABRIC.

BACKGROUND OF THE INVENTION

This invention relates to an improved method and apparatus for removing pile distortions in fabric created by heat-setting and/or dyeing.

In the case of pile fabrics, which have been heat-set at a high temperature with the pile erect and then dyed at a lower temperature during which the pile is substantially disturbed, as in jet dyeing, it is then desired to have the pile return to its original erect condition. One attempt in solving this problem is the tensionless dryer. In this machine, the pile fabric is fed onto a mesh belt that is then transported through a long heated tunnel where either mechanical action or perpendicular air blasts directed at the belt cause the fabric to undergo rather gentle undulations. The fabric is statically charged by friction with the air or contact with various parts of the dryer. The required processing time results in a drying unit over one hundred feet long with a low fabric line speed. There are quality problems associated with a lack of control over the fabric for such a long distance and well as marks that occur when the fabric strikes the upper section of the tunnel.

Another type of pile conditioning device is the use of a high velocity air jet such as U.S. Pat. No. 4,837,902.

In this case, the fabric is heated to the desired temperature and the conditioning is accomplished almost instantaneously by vigorous sawtoothed shaped waves that are small in amplitude, but effective due to high accelerations normal to the fabric surface produced by the wave's small bending radius and high velocity. The disadvantage of this process is direct contact of the heated fabric with the air stream, which tensions the fabric and can set in distortions in sensitive knit fabrics. Also, this process is less effective with highly permeable fabrics, as the air may not be trapped between the fabric and plate.

Yet another type of device vibrates and charges the pile fabric in the heated condition by contact with pneumatically excited diaphragms. The contact of the fabric with the diaphragms combined with the rapid vibrations induced by the air stream cause the diaphragm to wear out at a rate in which replacement can be a daily occurrence.

Still another type of device vibrates and charges the pile fabric biaxially by means of a rotating cylindrical roll with spaced protrusions or depressions along the exterior surface of the cylinder, followed by optionally vibrating the fabric axially by means of a second rotating cylindrical roll having flat portions continuously extending along the longitudinal axis of the second cylinder. The repeated and rapid front to back and side to side movement of individual pile fibers caused by multiple vibrational waves during biaxial treatment allows the fibers to return to their preferred heat-set orientation.

The present invention solves the above problems in a manner not disclosed in the known prior art.

SUMMARY OF THE INVENTION

A method and apparatus for continuous treatment of webs of fabric having upright pile comprised of wetting the fabric to at least 50% saturation, heating the fabric to approximately 225° to 350° Fahrenheit and then brushing the fabric in both the pile and counter-pile directions. The presence of liquid and steam plasticize and lubricate the fibers, thereby allowing an easier, more complete return to the uncrushed state.

An advantage of this invention is that it does not require the high temperatures of dry face finishing and also results in a less cloudy or a more clear face finish.

It is another advantage of this invention that it is able to work on wet fabrics so that jet-dyed pile fabrics straight from the dye jet are able to be treated without the need for intermediate drying. This not only reduces processing costs but also reduces wear and tear on the fabric by eliminating a costly pass down a tenter range utilized for drying.

Another advantage of this invention is that the treatment is completely uniform without any highlights.

Still another advantage of this invention is that the crushed pile might be in any direction and will be processed and come out in only one solitary direction.

Another advantage of this invention is that there is a blooming of tuft which provides a cover effect and fullness. It also creates a greater softness in the fabric due to the spreading out of the tuft.

Yet another advantage of this invention is that the fabric may be dried at the same time as treated. This will eliminate another processing step.

Yet another advantage of this invention is that it will allow face finishing of lower melting point fibers such as polypropylene and polyethylene. It is more effective in the transference of treatment to the fabric.

Still another advantage to this invention is that it is very effective with less point contact.

These and other advantages will be in part apparent and in part pointed out below.

BRIEF DESCRIPTION OF THE DRAWINGS

The above, as well as other objects of the invention, will become more apparent from the following detailed description of the preferred embodiments of the invention, which when taken together with the accompanying drawings, in which:

FIG. 9 is a cross-section taken through the middle of the third mechanism for heating and brushing fabric as shown in FIG. 4.

Corresponding reference characters indicate corresponding parts throughout the several views of the drawings.

DETAILED DESCRIPTION OF THE PREFERRED EMBODIMENT

Figure 1:
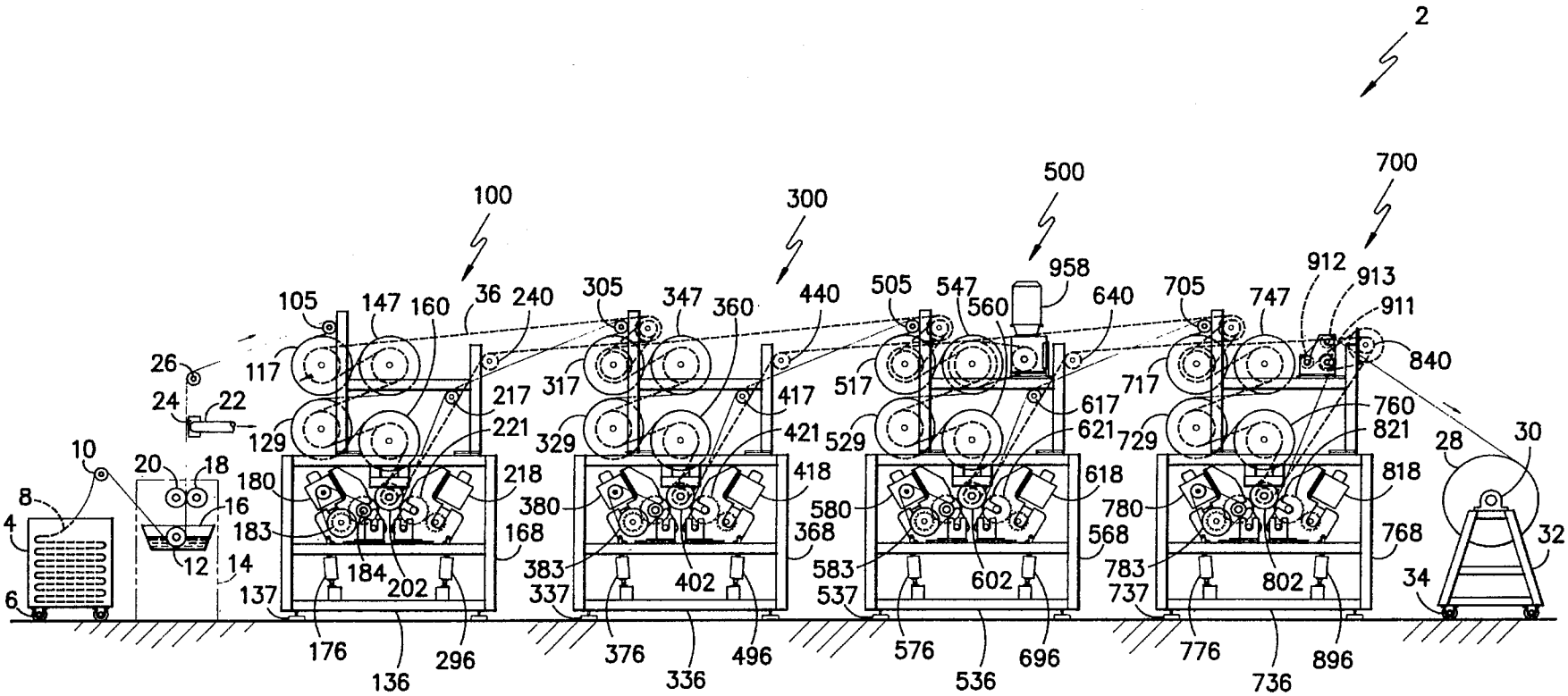
FIG. 1 is a diagrammatic side elevational view of the apparatus constructed according to the present invention with the fabric being initially saturated with liquid and then heated and brushed by a series of four units in both directions in order to restore the pile.

Referring now by reference numerals to the drawings, and first to FIG. 1, assembly to erect pile fabric is generally indicated by numeral 2. The pile fabric 8 is initially removed, with the pile side down, from a buggy 4 movably supported by four rollers 6. The pile fabric 8 is then directed angularly upward by a first idler roll 10 and then angularly downward through second idler roll 12 which submerges the pile fabric 8 in a container of liquid 16. This liquid can be any variety of chemicals, however, water is preferred. Furthermore, the temperature of the liquid is not critical and can range from between above freezing to boiling. The container of liquid 16 is held in place by a support frame 14. The pile fabric 8 then passes through a pair of nip rolls 18 and 20, respectively. The pile fabric 8 then passes by a vacuum slot 24 having a tube mechanism 22 for expelling the stream of air. This will remove trapped liquid from the pile fabric, leaving it at 100% saturation with no entrapped liquid. However, this does not have to be 100% saturation and can be anything above 50%. The pile fabric 8 then moves vertically upward and then passes over idler roll 26 and onward to the first heating and brushing mechanism generally indicated by numeral 100.

Figure 2:
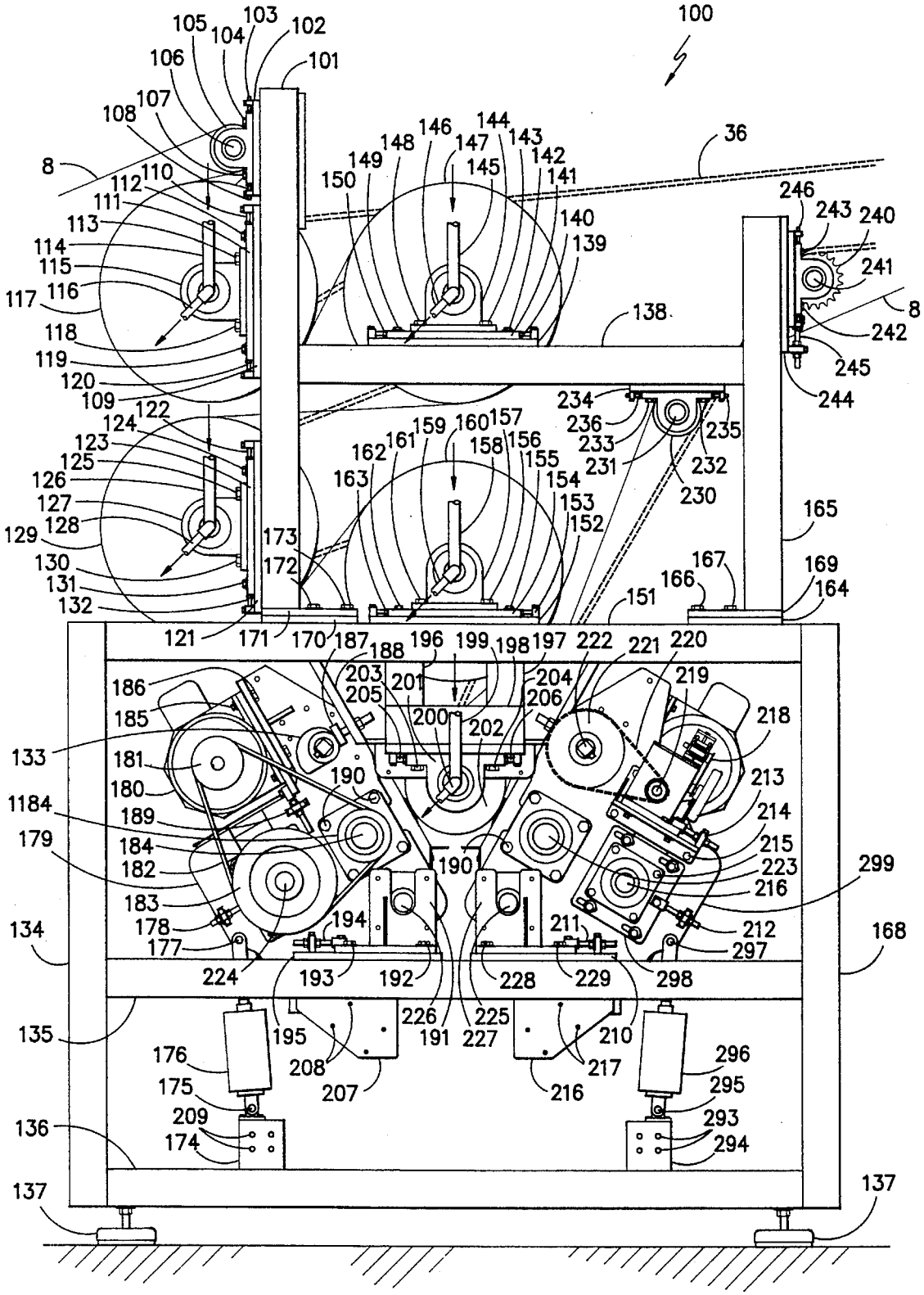
FIG. 2 is an elevational side view of a first mechanism for heating and brushing pile fabric.

Referring now to FIGS. 1–9, all four heating and brushing mechanisms have identical frame structures. Identical components will only differ by the first number with numbers in the nine hundred series being identical for all heating and brushing mechanisms. This rectangular structure has a pair of left vertical members 134 and a pair of right vertical members 168 and a pair of top horizontal members 151 and a pair of bottom horizontal members 136 with a pair of middle horizontal members 135 in between, as shown in FIG. 2. As shown in FIG. 9, each opposed end of left vertical members 534 have a pair of lateral support braces 667, 650 and located at each opposed end of right vertical members 568 are a pair of lateral support braces 668, 681, respectively.

Attached to the top horizontal members 551 are a pair of upper left vertical members 501 with lateral support brace 682 located at the upper end thereof. There is a pair of upper right vertical members 565 with lateral support brace 689 located at the middle of the upper right vertical members 565. There is a pair of upper middle horizontal support members 538 located between the upper left vertical members 501 and upper right vertical members 565 with a lateral support brace 684 located therebetween.

As shown in FIG. 2, upper right vertical members 165 are attached to the top horizontal members 151 by means of bolts 166 and 167 through plates 169 and 164. Upper left vertical members 101 are attached to the top horizontal members 151 by means of bolts 172 and 173 through plates 171 and 170.

Referring again specifically to the first heating and brushing mechanism generally indicated by numeral 100, as shown in FIG. 2, the pile fabric 8 passes through an upper directing idler roll 105. There is a pair of bearing members 106 rotatably attached to upper directing idler roll 105. Each bearing member 106 are bolted to an adjustment member 102 by means of bolts 104 and 107. There are two adjustment mechanisms 103 and 108 for each bearing member 106, which uses a combination of flanges attached to adjustment member 102 and a threaded bolt with nuts on each side of the flanges attached to the adjustment member 102 to shift upwardly directing idler roll 105 vertically along upper left vertical member 101. Adjustment member 102 is fixedly attached to upper left vertical member 101. The pile fabric 8 then goes around the outside of first steam roll 117. First steam roll 117 is rotatably attached to upper left vertical member 101 by means of a pair of bearing members 115 that are attached to a first steam roll mounting plate 111 by means of bolts 113 and 118, respectively. The first steam roll mounting plate 111 is attached to a first steam roll adjustment member 109 by a pair of bolts 112 and 116. The first steam roll adjustment member 109 has a pair of flanges and there are two first steam roll adjustment mechanisms 110 and 120 which in conjunction with bolts and nuts operating on the flanges as previously described allow the steam roll 117 to shift vertically along upper left vertical member 101. There are two first steam plate bearing members 115 with another identical member on the other side of first steam roll 117 which is not shown and serves to hold first steam roll 117 in a rotatable position. There is a first steam roll input 114 to introduce water vapor into first steam roll 117 as well as a first steam roll condensate tube 116 to remove condensed liquid from first steam roll 117.

Pile fabric 8 then travels around the outside perimeter of second steam roll 147. Second steam roll 147 is rotatably attached to upper middle horizontal support members 138 by means of a pair of bearing members 144. Bearing members 144 are attached to a second steam roll mounting plate 141 by means of bolts 143 and 148, respectively. The second steam roll mounting plate 141 is attached to a second steam roll adjustment member 139 by a pair of bolts 149 and 142. The second steam roll adjustment member 139 has a pair of flanges and there are two first steam roll adjustment mechanisms 140 and 150 which in conjunction with bolts and nuts operating on the flanges as previously described allow the second steam roll 147 to shift horizontally along upper middle horizontal support members 138. There are two second steam plate bearing members 144 with another identical member on the other side of second steam roll 147 which is not shown and serves to hold second steam roll 147 in a rotatable position. There is a second steam roll input 145 to introduce water vapor into second steam roll 147 as well as a second steam roll condensate tube 146 to remove condensed liquid from second steam roll 147.

The pile fabric 8 then goes around the outside of third steam roll 129. Third steam roll 129 is rotatably attached to upper left vertical member 101 by means of a pair of bearing members 127 that are attached to a third steam roll mounting plate 123 by means of bolts 125 and 130, respectively. The third steam roll mounting plate 123 is attached to a third steam roll adjustment member 121 by a pair of bolts 124 and 131. The third steam roll adjustment member 121 has a pair of flanges and there are two third steam roll adjustment mechanisms 122 and 132 which in conjunction with bolts and nuts operating on the flanges as previously described allow the third steam roll 129 to shift vertically along upper left vertical member 101. There are two third steam plate bearing members 127 with another identical member on the other side of third steam roll 129 which is not shown and serves to hold third steam roll 129 in a rotatable position. There is a third steam roll input 126 to introduce water vapor into third steam roll 129 as well as a third steam roll condensate tube 128 to remove condensed liquid from third steam roll 129.

Pile fabric 8 then travels around the outside perimeter of fourth steam roll 160. Fourth steam roll 160 is rotatably attached to top horizontal support members 151 by means of a pair of bearing members 157. Bearing members 157 are attached to a fourth steam roll mounting plate 154 by means of bolts 156 and 161, respectively. The fourth steam roll mounting plate 154 is attached to a fourth steam roll adjustment member 152 by a pair of bolts 155 and 162. The fourth steam roll adjustment member 152 has a pair of flanges and there are two fourth steam roll adjustment mechanisms 153 and 163 which in conjunction with bolts and nuts operating on the flanges as previously described allow the fourth steam roll 160 to shift horizontally along top horizontal support members 151. There are two fourth steam plate bearing members 157 with another identical member on the other side of fourth steam roll 160 which is not shown and serves to hold fourth steam roll 160 in a rotatable position. There is a fourth steam roll input 158 to introduce water vapor into second steam roll 160 as well as a fourth steam roll condensate tube 159 to remove condensed liquid from fourth steam roll 160.

The pile fabric 8 then travels around fifth steam roll 202 which is the primary steam roll that is used in conjunction with the brushing action. This is rotatably attached by means by a pair of bearing mechanisms 201 which are held by bolts 203 and 204 to horizontal support member 198 which has a left horizontal member 196 and a right horizontal member 197 attached thereto which connect to the underside of top horizontal member 151, respectively. There are a pair of adjustment mechanisms 205 and 206, respectively to be able to shift fifth steam roll 202 horizontally. There is also a fifth steam input 199 and steam condensate tube 200 associated with the fifth primary steam roll 202. There are two brushing mechanisms shown on the left and right of fifth steam roll 202 which are identical, but reversed.

The brushing mechanism on the left has a first housing frame 179 that is connected to a pair of pivot shafts 226 that are rotatably supported in a pair of pivot members 191. Pivot members 191 are attached to adjustment member 195 by means of bolts 192 and 193, respectfully and having an adjustment mechanism 194, as previously described for horizontal movement of the pivot shafts 226 along middle horizontal members 135.

The brushing mechanism on the right has a second housing frame 299 that is connected to a pair of pivot shafts 225 that are rotatably supported in a pair of pivot members 227. Pivot members 227 are attached to adjustment member 210 by means of bolts 228 and 229, respectfully and having an adjustment mechanism 211, as previously described for horizontal movement of the pivot shafts 225 along middle horizontal members 135.

There is a positioning bracket 188 that allows the first housing frame 179 to come back to the exact same position for the same degree of brush penetration. There is an adjustable stop 187 that is connected to the positioning bracket 188 that can be moved toward and away from the face of the positioning bracket 188 to adjust the stop of the first housing frame 179. The adjustable stop 187 will abut an eccentric cam 133 when in position. As shown on the right brushing mechanism, the eccentric cam 133 is mounted on a shaft 222 that is connected to a pulley 221 that is moved by means of an endless belt 220 that is connected to a secondary pulley 219 that is rotated by a hand crank 218 having a pin mechanism to lock the hand crank 218 into position. There is another adjustment mechanism 213 that moves secondary pulley 219 to place tension on endless belt 220. Adjustment mechanism 213 is mounted to the second housing frame 299 by a series of three bolts 214.

There is a motor 180 which drives the system having a pulley 181 and endless belt mechanism 182. This endless belt mechanism 182 drives cylindrical brush 184 by means of attached pulley 1184. Cylindrical brush 184 is rotatably attached to bearing plates 223 that are attached by means of four bolts 190. Endless belt mechanism 182 also drives a cleaning roll 183 with associated pulley 224 the removes lint and debris from the cylindrical brush 184. Cylindrical brush 184 has bristles that can be of any length and only need to contact the fabric between just barely touching the fabric to almost touching the backing of the fabric. The preferred length of bristles is 0.25 to 1.75 inches. It is preferable that these bristles are of stainless steel or of some other non-corrosive material. These bristles also can be coated. The density of the bristles depend on the effect desired and the type of pile fabric brushed. Cleaning roll 183 needs to be able to engage the bristles of cylindrical brush 184. Both cylindrical brushes 184 will engage the fabric that is passed around the outside of the fifth steam roll 202. The preferred r.p.m. of the cylindrical brushes is a range of 500 to 600 with a possible range of 0 to 3000.

The pile fabric 8 will preferably pass through this invention at a rate of thirty yards per minute, however, any speed between 0 to 250 yards per minute will work.

Motor 180 is mounted to both frame 179 and 299 by means of bolts 185 and 186 and adjustment mechanism 189. Cleaning roll 183 is mounted in a adjustable bearing assembly plate 216 with a set of four inner bolts 215 and an outer slotted plate assembly 298 with another four bolts with a pair a adjustment mechanisms 178 and 212 attached thereto.

First housing frame 179 is supported by a pin member 177 and there is an air cylinder 176 that is also pivotally mounted by means of pin 175 to a support member 174. There are four bolts 209 attached to a plate which also provides support, as also shown in FIG. 9. Support member 174 is attached to bottom horizontal member 136.

There is a shock absorber shown in FIG. 9 as numeral 670 mounted by means of four bolts 208 to plate member 207 that is attached to middle horizontal member 135. This same structure is replicated on the right hand side with second housing frame 298 supported by a pin member 297 and there is an air cylinder 296 that is also pivotally mounted by means of pin 295 to a support member 294. There are four bolts 293 attached to a plate which also provides support, as also shown in FIG. 9. Support member 294 is attached to bottom horizontal member 136. There is a shock absorber shown in FIG. 9 as numeral 671 mounted by means of four bolts 217 to plate member 216 that is attached to middle horizontal member 135.

All heating and brushing mechanisms to erect pile fabric 8 are mounted on adjustable levelers 137 utilizing dual nut with threaded bolt combination. Air cylinders 176, 376, 576, and 776 have inputs 253, 453, 653 and 853 and outputs 252, 452, 652 and 852, respectively. Air cylinders 296, 496, 696 and 896 have an inputs and 254, 454, 654 and 854 and outputs 255, 455, 655 and 855, respectively.

Pile fabric 8 then goes through lower idler roll 230 which is rotatably supported by pair of bearings 231 which is bolted by means of bolts 232 and 233 to adjustment member 234 having adjustment means 235 and 236 as previously described which attach to the underside of upper middle horizontal support member 138. Pile fabric 8 then exits the first heating and brushing mechanism 100 and enters the second brushing and heating mechanism 300 which essentially replicates heating mechanism 100 which for the sake of clarity will be described again.

Referring again specifically to the second heating and brushing mechanism generally indicated by numeral 300, as shown in FIG. 2, the pile fabric 8 passes through an upper directing idler roll 305. There is a pair of bearing members 306 rotatably attached to upper directing idler roll 305. Each bearing member 306 are bolted to an adjustment member 302 by means of bolts 304 and 307. There are two adjustment mechanisms 303 and 308 for each bearing member 306, which uses a combination of flanges attached to adjustment member 302 and a threaded bolt with nuts on each side of the flanges attached to the adjustment member 302 to shift upwardly directing idler roll 305 vertically along upper left vertical member 301. Adjustment member 302 is fixedly attached to upper left vertical member 301. The pile fabric 8 then goes around the outside of first steam roll 317. First steam roll 317 is rotatably attached to upper left vertical member 301 by means of a pair of bearing members 315 that are attached to a first steam roll mounting plate 311 by means of bolts 313 and 318, respectively. The first steam roll mounting plate 311 is attached to a first steam roll adjustment member 309 by a pair of bolts 312 and 316. The first steam roll adjustment member 309 has a pair of flanges and there are two first steam roll adjustment mechanisms 310 and 320 which in conjunction with bolts and nuts operating on the flanges as previously described allow the steam roll 317 to shift vertically along upper left vertical member 301. There are two first steam plate bearing members 315 with another identical member on the other side of first steam roll 317 which is not shown and serves to hold first steam roll 317 in a rotatable position.

There is a first steam roll input 314 to introduce water vapor into first steam roll 317 as well as a first steam roll condensate tube 316 to remove condensed liquid from first steam roll 317.

Pile fabric 8 then travels around the outside perimeter of second steam roll 347. Second steam roll 347 is rotatably attached to upper middle horizontal support members 338 by means of a pair of bearing members 344. Bearing members 344 are attached to a second steam roll mounting plate 341 by means of bolts 343 and 348, respectively. The second steam roll mounting plate 341 is attached to a second steam roll adjustment member 339 by a pair of bolts 349 and 342. The second steam roll adjustment member 339 has a pair of flanges and there are two first steam roll adjustment mechanisms 340 and 350 which in conjunction with bolts and nuts operating on the flanges as previously described allow the second steam roll 347 to shift horizontally along upper middle horizontal support members 338. There are two second steam plate bearing members 344 with another identical member on the other side of second steam roll 347 which is not shown and serves to hold second steam roll 347 in a rotatable position. There is a second steam roll input 345 to introduce water vapor into second steam roll 347 as well as a second steam roll condensate tube 346 to remove condensed liquid from second steam roll 347.

The pile fabric 8 then goes around the outside of third steam roll 329. Third steam roll 329 is rotatably attached to upper left vertical member 301 by means of a pair of bearing members 327 that are attached to a third steam roll mounting plate 323 by means of bolts 325 and 330, respectively. The third steam roll mounting plate 323 is attached to a third steam roll adjustment member 321 by a pair of bolts 324 and 331. The third steam roll adjustment member 321 has a pair of flanges and there are two third steam roll adjustment mechanisms 322 and 332 which in conjunction with bolts and nuts operating on the flanges as previously described allow the third steam roll 329 to shift vertically along upper left vertical member 301. There are two third steam plate bearing members 327 with another identical member on the other side of third steam roll 329 which is not shown and serves to hold third steam roll 329 in a rotatable position. There is a third steam roll input 326 to introduce water vapor into third steam roll 329 as well as a third steam roll condensate tube 328 to remove condensed liquid from third steam roll 329.

Pile fabric 8 then travels around the outside perimeter of fourth steam roll 360. Fourth steam roll 360 is rotatably attached to top horizontal support members 351 by means of a pair of bearing members 357. Bearing members 357 are attached to a fourth steam roll mounting plate 354 by means of bolts 356 and 361, respectively. The fourth steam roll mounting plate 354 is attached to a fourth steam roll adjustment member 352 by a pair of bolts 355 and 362. The fourth steam roll adjustment member 352 has a pair of flanges and there are two fourth steam roll adjustment mechanisms 353 and 363 which in conjunction with bolts and nuts operating on the flanges as previously described allow the fourth steam roll 360 to shift horizontally along top horizontal support members 351. There are two fourth steam plate bearing members 357 with another identical member on the other side of fourth steam roll 360 which is not shown and serves to hold fourth steam roll 360 in a rotatable position. There is a fourth steam roll input 358 to introduce water vapor into second steam roll 360 as well as a fourth steam roll condensate tube 359 to remove condensed liquid from fourth steam roll 360.

The pile fabric 8 then travels around fifth steam roll 402 which is the primary steam roll that is used in conjunction with the brushing action. This is rotatably attached by means by a pair of bearing mechanisms 401 which are held by bolts 403 and 404 to horizontal support member 398 which has a left horizontal member 396 and a right horizontal member 397 attached thereto which connect to the underside of top horizontal member 351, respectively. There are a pair of adjustment mechanisms 405 and 406, respectively to be able to shift fifth steam roll 402 horizontally. There is also a fifth steam input 399 and steam condensate tube 400 associated with the fifth primary steam roll 402. There are two brushing mechanisms shown on the left and right of fifth steam roll 402 which are identical, but reversed.

The brushing mechanism on the left has a first housing frame 379 that is connected to a pair of pivot shafts 426 that are rotatably supported in a pair of pivot members 391. Pivot members 391 are attached to adjustment member 395 by means of bolts 392 and 393, respectfully and having an adjustment mechanism 394, as previously described for horizontal movement of the pivot shafts 426 along middle horizontal members 335.

The brushing mechanism on the right has a second housing frame 499 that is connected to a pair of pivot shafts 425 that are rotatably supported in a pair of pivot members 427. Pivot members 427 are attached to adjustment member 410 by means of bolts 428 and 429, respectfully and having an adjustment mechanism 411, as previously described for horizontal movement of the pivot shafts 425 along middle horizontal members 335.

There is a positioning bracket 388 that allows the first housing frame 379 to come back to the exact same position for the same degree of brush penetration. There is an adjustable stop 387 that is connected to the positioning bracket 388 that can be moved toward and away from the face of the positioning bracket 388 to adjust the stop of the first housing frame 379. The adjustable stop 387 will abut an eccentric cam 333 when in position. As shown on the right brushing mechanism, the eccentric cam 333 is mounted on a shaft 422 that is connected to a pulley 421 that is moved by means of an endless belt 420 that is connected to a secondary pulley 419 that is rotated by a hand crank 418 having a pin mechanism to lock the hand crank 418 into position. There is another adjustment mechanism 413 that moves secondary pulley 419 to place tension on endless belt 420. Adjustment mechanism 413 is mounted to the second housing frame 499 by a series of three bolts 414.

There is a motor 380 which drives the system having a pulley 381 and endless belt mechanism 382. This endless belt mechanism 382 drives cylindrical brush 384 by means of attached pulley 1384. Cylindrical brush 384 is rotatably attached to bearing plates 423 that are attached by means of four bolts 390. Endless belt mechanism 382 also drives a cleaning roll 383 with associated pulley 424 the removes lint and debris from the cylindrical brush 384. Cylindrical brush 384 has bristles that can be of any length and only need to contact the fabric between just barely touching the fabric to almost touching the backing of the fabric. The preferred length of bristles is 0.25 to 1.75 inches. It is preferable that these bristles are of stainless steel or of some other non-corrosive material. These bristles also can be coated. The density of the bristles depend on the effect desired and the type of pile fabric brushed. Cleaning roll 383 needs to be able to engage the bristles of cylindrical brush 384. Both cylindrical brushes 384 will engage the fabric that is passed around the outside of the fifth steam roll 402. The preferred r.p.m. of the cylindrical brushes is a range of 500 to 600 with a possible range of 0 to 3000. The pile fabric 8 will preferably pass through this invention at a rate of thirty yards per minute, however, any speed between 0 to 250 yards per minute will work.

Motor 380 is mounted to both frame 379 and 499 by means of bolts 385 and 386 and adjustment mechanism 389. Cleaning roll 383 is mounted in a adjustable bearing assembly plate 416 with a set of four inner bolts 415 and an outer slotted plate assembly 498 with another four bolts with a pair a adjustment mechanisms 378 and 412 attached thereto.

First housing frame 379 is supported by a pin member 377 and there is an air cylinder 376 that is also pivotally mounted by means of pin 375 to a support member 374. There are four bolts 409 attached to a plate which also provides support, as also shown in FIG. 9. Support member 374 is attached to bottom horizontal member 336.

There is a shock absorber shown in FIG. 9 as numeral 670 mounted by means of four bolts 408 to plate member 407 that is attached to middle horizontal member 335. This same structure is replicated on the right hand side with second housing frame 498 supported by a pin member 497 and there is an air cylinder 496 that is also pivotally mounted by means of pin 495 to a support member 494. There are four bolts 493 attached to a plate which also provides support, as also shown in FIG. 9. Support member 494 is attached to bottom horizontal member 336. There is a shock absorber shown in FIG. 9 as numeral 671 mounted by means of four bolts 417 to plate member 416 that is attached to middle horizontal member 335.

All heating and brushing mechanisms to erect pile fabric 8 are mounted on adjustable levelers 337 utilizing dual nut with threaded bolt combination. Air cylinders 176, 376, 576, and 776 have inputs 253,453, 653 and 853 and outputs 252, 452, 652 and 852, respectively. Air cylinders 296, 496, 696 and 896 have an inputs and 254, 454, 654 and 854 and outputs 255, 455, 655 and 855, respectively.

Pile fabric 8 then goes through lower idler roll 430 which is rotatably supported by pair of bearings 431 which is bolted by means of bolts 432 and 433 to adjustment member 434 having adjustment means 435 and 436 as previously described which attach to the underside of upper middle horizontal support member 338. Pile fabric 8 then exits the second heating and brushing mechanism 300 and enters the third brushing and heating mechanism 500 which essentially replicates heating mechanism 300 which for the sake of clarity will be described again.

Figure 3:
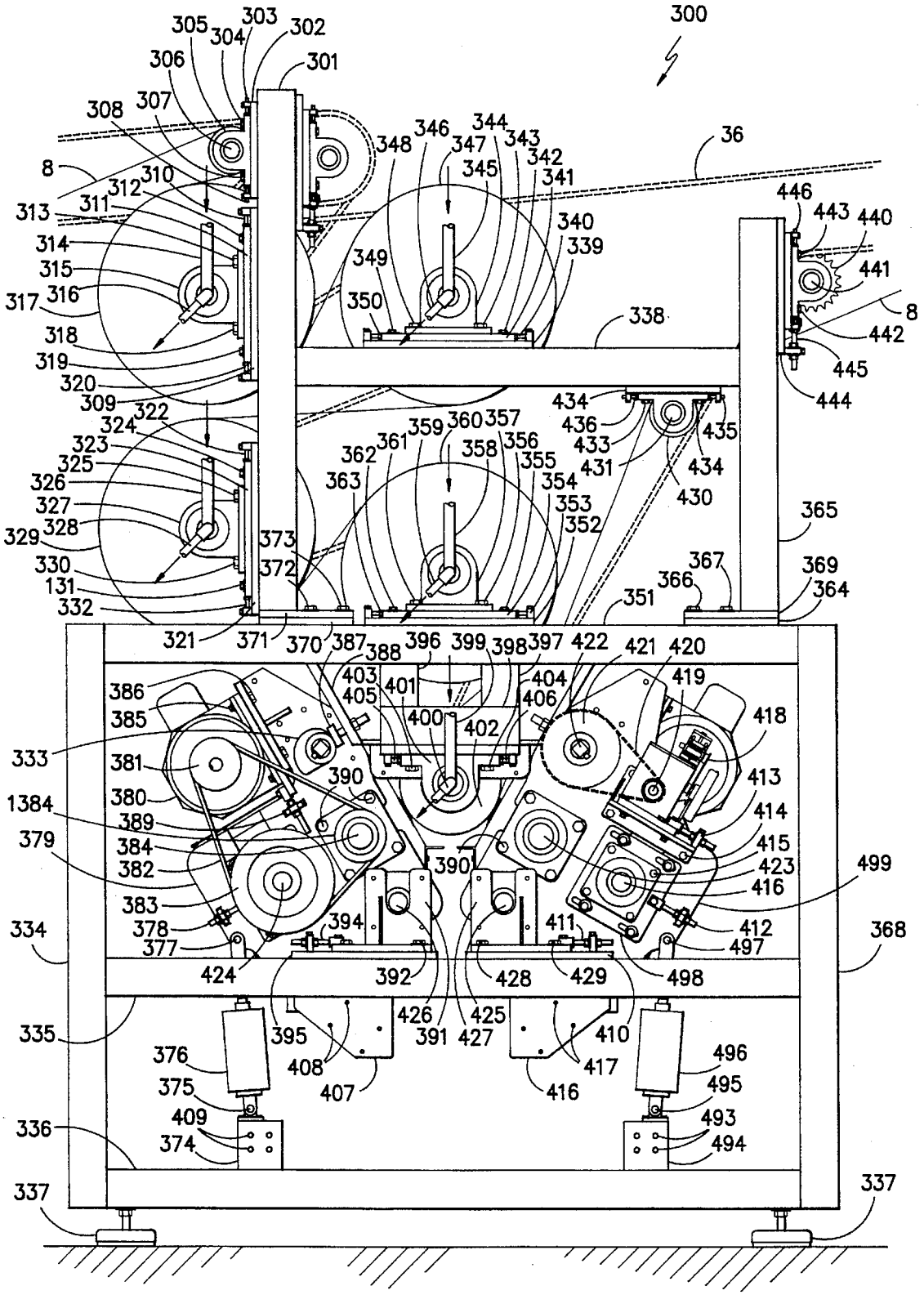
FIG. 3 is an elevational side view of a second mechanism for heating and brushing fabric.
Figure 6:
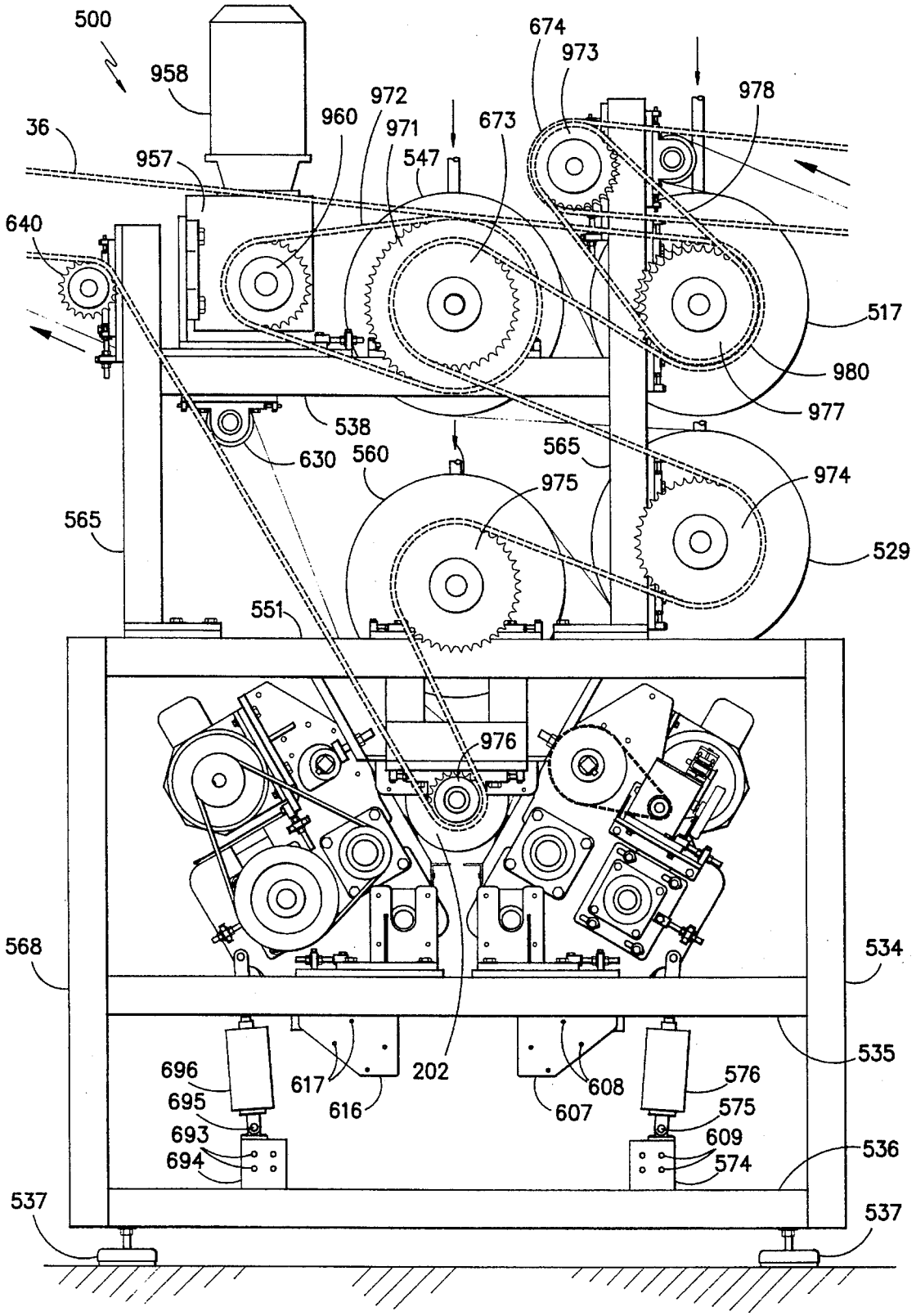
FIG. 6 is an elevational side view corresponding to FIG. 4 only that it represents the opposite side of the third mechanism for heating and brushing pile fabric.
Figure 7:
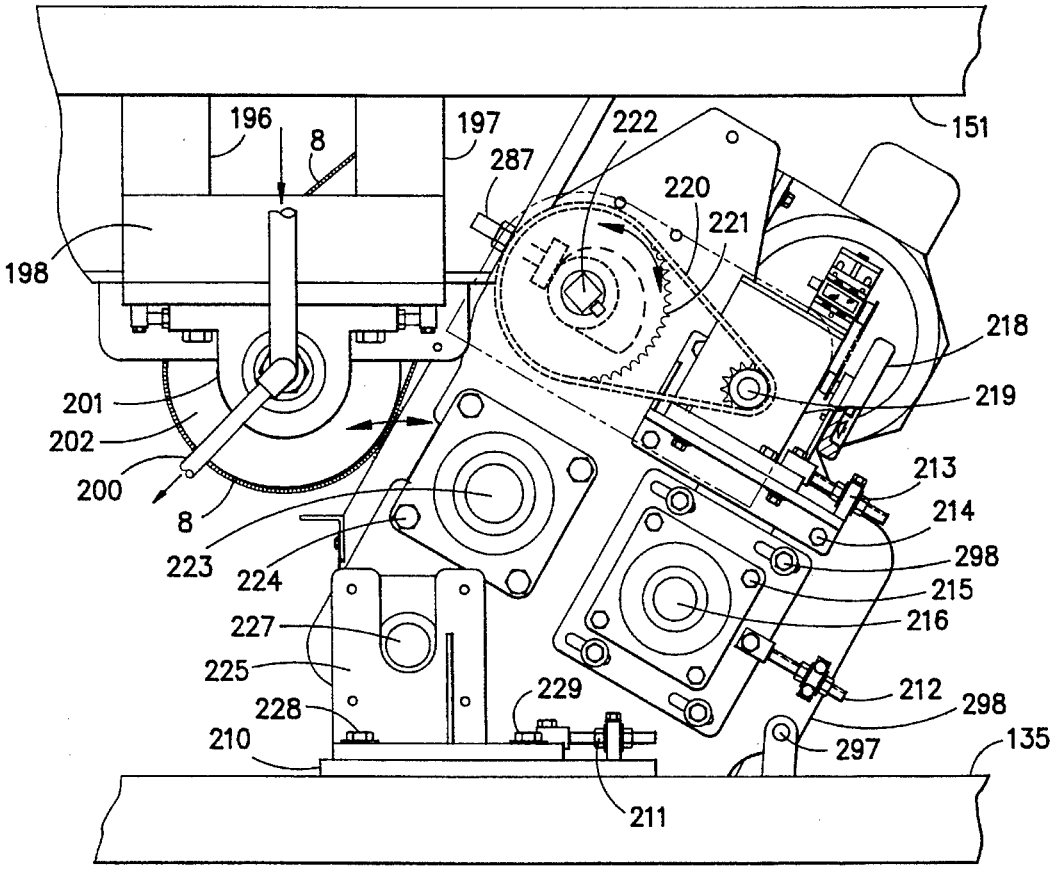
FIG. 7 is an isolated side view of the brushing mechanism as shown in FIG. 2.

Referring again specifically to the third heating and brushing mechanism generally indicated by numeral 500, as shown in FIG. 3, 6 and 9, the pile fabric 8 passes through an upper directing idler roll 505. There is a pair of bearing members 506 rotatably attached to upper directing idler roll 505. Each bearing member 506 are bolted to an adjustment member 502 by means of bolts 504 and 507. There are two adjustment mechanisms 503 and 508 for each bearing member 506, which uses a combination of flanges attached to adjustment member 502 and a threaded bolt with nuts on each side of the flanges attached to the adjustment member 502 to shift upwardly directing idler roll 505 vertically along upper left vertical member 501. Adjustment member 502 is fixedly attached to upper left vertical member 501. The pile fabric 8 then goes around the outside of first steam roll 517. First steam roll 517 is rotatably attached to upper left vertical member 501 by means of a pair of bearing members 515 that are attached to a first steam roll mounting plate 511 by means of bolts 513 and 518, respectively. The first steam roll mounting plate 511 is attached to a first steam roll adjustment member 509 by a pair of bolts 512 and 516. The first steam roll adjustment member 509 has a pair of flanges and there are two first steam roll adjustment mechanisms 510 and 520 which in conjunction with bolts and nuts operating on the flanges as previously described allow the steam roll 517 to shift vertically along upper left vertical member 501. There are two first steam plate bearing members 515 with another identical member on the other side of first steam roll 517 which is not shown and serves to hold first steam roll 517 in a rotatable position. There is a first steam roll input 514 to introduce water vapor into first steam roll 517 as well as a first steam roll condensate tube 516 to remove condensed liquid from first steam roll 517.

Pile fabric 8 then travels around the outside perimeter of second steam roll 547. Second steam roll 547 is rotatably attached to upper middle horizontal support members 538 by means of a pair of bearing members 544. Bearing members 544 are attached to a second steam roll mounting plate 541 by means of bolts 543 and 548, respectively. The second steam roll mounting plate 541 is attached to a second steam roll adjustment member 539 by a pair of bolts 549 and 542. The second steam roll adjustment member 539 has a pair of flanges and there are two first steam roll adjustment mechanisms 540 and 550 which in conjunction with bolts and nuts operating on the flanges as previously described allow the second steam roll 547 to shift horizontally along upper middle horizontal support members 538. There are two second steam plate bearing members 544 with another identical member on the other side of second steam roll 547 which is not shown and serves to hold second steam roll 547 in a rotatable position. There is a second steam roll input 545 to introduce water vapor into second steam roll 547 as well as a second steam roll condensate tube 546 to remove condensed liquid from second steam roll 547.

The pile fabric 8 then goes around the outside of third steam roll 529. Third steam roll 529 is rotatably attached to upper left vertical member 501 by means of a pair of bearing members 527 that are attached to a third steam roll mounting plate 523 by means of bolts 525 and 530, respectively. The third steam roll mounting plate 523 is attached to a third steam roll adjustment member 521 by a pair of bolts 524 and 531. The third steam roll adjustment member 521 has a pair of flanges and there are two third steam roll adjustment mechanisms 522 and 532 which in conjunction with bolts and nuts operating on the flanges as previously described allow the third steam roll 529 to shift vertically along upper left vertical member 501. There are two third steam plate bearing members 527 with another identical member on the other side of third steam roll 529 which is not shown and serves to hold third steam roll 529 in a rotatable position. There is a third steam roll input 526 to introduce water vapor into third steam roll 529 as well as a third steam roll condensate tube 528 to remove condensed liquid from third steam roll 529.

Pile fabric 8 then travels around the outside perimeter of fourth steam roll 560. Fourth steam roll 560 is rotatably attached to top horizontal support members 551 by means of a pair of bearing members 557. Bearing members 557 are attached to a fourth steam roll mounting plate 554 by means of bolts 556 and 561, respectively. The fourth steam roll mounting plate 554 is attached to a fourth steam roll adjustment member 552 by a pair of bolts 555 and 562. The fourth steam roll adjustment member 552 has a pair of flanges and there are two fourth steam roll adjustment mechanisms 553 and 565 which in conjunction with bolts and nuts operating on the flanges as previously described allow the fourth steam roll 560 to shift horizontally along top horizontal support members 551. There are two fourth steam plate bearing members 557 with another identical member on the other side of fourth steam roll 560 which is not shown and serves to hold fourth steam roll 560 in a rotatable position. There is a fourth steam roll input 558 to introduce water vapor into second steam roll 560 as well as a fourth steam roll condensate tube 559 to remove condensed liquid from fourth steam roll 560.

The pile fabric 8 then travels around fifth steam roll 602 which is the primary steam roll that is used in conjunction with the brushing action. This is rotatably attached by means by a pair of bearing mechanisms 601 which are held by bolts 603 and 604 to horizontal support member 598 which has a left horizontal member 596 and a right horizontal member 597 attached thereto which connect to the underside of top horizontal member 551, respectively. There are a pair of adjustment mechanisms 605 and 606, respectively to be able to shift fifth steam roll 602 horizontally. There is also a fifth steam input 599 and steam condensate tube 600 associated with the fifth primary steam roll 602. There are two brushing mechanisms shown on the left and right of fifth steam roll 602 which are identical, but reversed.

The brushing mechanism on the left has a first housing frame 579 that is connected to a pair of pivot shafts 626 that are rotatably supported in a pair of pivot members 591. Pivot members 591 are attached to adjustment member 595 by means of bolts 592 and 593, respectfully and having an adjustment mechanism 594, as previously described for horizontal movement of the pivot shafts 626 along middle horizontal members 535.

The brushing mechanism on the right has a second housing frame 699 that is connected to a pair of pivot shafts 625 that are rotatably supported in a pair of pivot members 627. Pivot members 627 are attached to adjustment member 610 by means of bolts 628 and 629, respectfully and having an adjustment mechanism 611, as previously described for horizontal movement of the pivot shafts 625 along middle horizontal members 535.

There is a positioning bracket 588 that allows the first housing frame 579 to come back to the exact same position for the same degree of brush penetration. There is an adjustable stop 587 that is connected to the positioning bracket 588 that can be moved toward and away from the face of the positioning bracket 588 to adjust the stop of the first housing frame 579. The adjustable stop 587 will abut an eccentric cam 533 when in position. As shown on the right brushing mechanism, the eccentric cam 533 is mounted on a shaft 622 that is connected to a pulley 621 that is moved by means of an endless belt 620 that is connected to a secondary pulley 619 that is rotated by a hand crank 618 having a pin mechanism to lock the hand crank 618 into position. There is another adjustment mechanism 613 that moves secondary pulley 619 to place tension on endless belt 620. Adjustment mechanism 613 is mounted to the second housing frame 699 by a series of three bolts 614.

There is a motor 580 which drives the system having a pulley 581 and endless belt mechanism 582. This endless belt mechanism 582 drives cylindrical brush 584 by means of attached pulley 1584. Cylindrical brush 584 is rotatably attached to bearing plates 623 that are attached by means of four bolts 590. Endless belt mechanism 582 also drives a cleaning roll 583 with associated pulley 624 the removes lint and debris from the cylindrical brush 584. Cylindrical brush 584 has bristles that can be of any length and only need to contact the fabric between just barely touching the fabric to almost touching the backing of the fabric. The preferred length of bristles is 0.25 to 1.75 inches. It is preferable that these bristles are of stainless steel or of some other non-corrosive material. These bristles also can be coated. The density of the bristles depend on the effect desired and the type of pile fabric brushed. Cleaning roll 583 needs to be able to engage the bristles of cylindrical brush 584. Both cylindrical brushes 584 will engage the fabric that is passed around the outside of the fifth steam roll 602. The preferred r.p.m. of the cylindrical brushes is a range of 500 to 600 with a possible range of 0 to 3000. The pile fabric 8 will preferably pass through this invention at a rate of thirty yards per minute, however, any speed between 0 to 250 yards per minute will work.

Motor 580 is mounted to both frame 579 and 699 by means of bolts 585 and 586 and adjustment mechanism 589. Cleaning roll 583 is mounted in a adjustable bearing assembly plate 616 with a set of four inner bolts 615 and an outer slotted plate assembly 698 with another four bolts with a pair a adjustment mechanisms 578 and 612 attached thereto.

First housing frame 579 is supported by a pin member 577 and there is an air cylinder 576 that is also pivotally mounted by means of pin 575 to a support member 574. There are four bolts 609 attached to a plate which also provides support, as also shown in FIG. 9. Support member 574 is attached to bottom horizontal member 536.

There is a shock absorber shown in FIG. 9 as numeral 670 mounted by means of four bolts 608 to plate member 607 that is attached to middle horizontal member 535. This same structure is replicated on the right hand side with second housing frame 698 supported by a pin member 697 and there is an air cylinder 696 that is also pivotally mounted by means of pin 695 to a support member 694. There are four bolts 693 attached to a plate which also provides support, as also shown in FIG. 9. Support member 694 is attached to bottom horizontal member 536. There is a shock absorber shown in FIG. 9 as numeral 671 mounted by means of four bolts 617 to plate member 616 that is attached to middle horizontal member 535.

All heating and brushing mechanisms to erect pile fabric 8 are mounted on adjustable levelers 537 utilizing dual nut with threaded bolt combination. Air cylinders 176, 376, 576, and 776 have inputs 253, 453, 653 and 853 and outputs 252, 452, 652 and 852, respectively. Air cylinders 296, 496, 696 and 896 have an inputs and 254, 454, 654 and 854 and outputs 255, 455, 655 and 855, respectively.

Pile fabric 8 then goes through lower idler roll 630 which is rotatably supported by pair of bearings 631 which is bolted by means of bolts 632 and 633 to adjustment member 634 having adjustment means 635 and 636 as previously described which attach to the underside of upper middle horizontal support member 538. Pile fabric 8 then exits the third heating and brushing mechanism 500 and enters the fourth brushing and heating mechanism 700 which essentially replicates heating mechanism 500 which for the sake of clarity will be described again.

Figure 4:
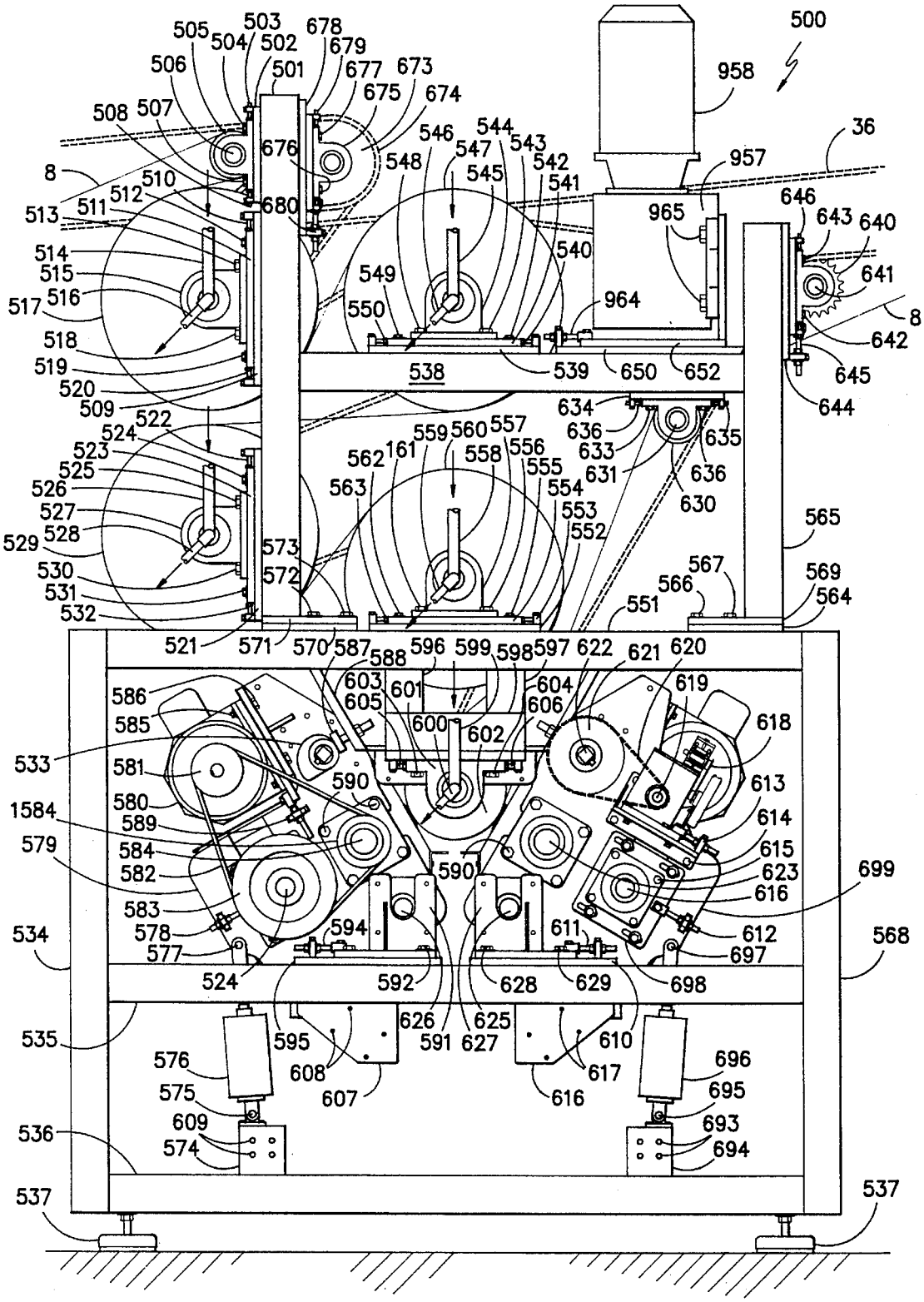
FIG. 4 is an elevational side view of a third mechanism for heating and brushing fabric.

Referring again specifically to the fourth heating and brushing mechanism generally indicated by numeral 700, as shown in FIG. 4, the pile fabric 8 passes through an upper directing idler roll 705. There is a pair of bearing members 706 rotatably attached to upper directing idler roll 705. Each bearing member 706 are bolted to an adjustment member 702 by means of bolts 704 and 707. There are two adjustment mechanisms 703 and 708 for each bearing member 706, which uses a combination of flanges attached to adjustment member 702 and a threaded bolt with nuts on each side of the flanges attached to the adjustment member 702 to shift upwardly directing idler roll 705 vertically along upper left vertical member 701. Adjustment member 702 is fixedly attached to upper left vertical member 701. The pile fabric 8 then goes around the outside of first steam roll 717. First steam roll 717 is rotatably attached to upper left vertical member 701 by means of a pair of bearing members 715 that are attached to a first steam roll mounting plate 711 by means of bolts 713 and 718, respectively. The first steam roll mounting plate 711 is attached to a first steam roll adjustment member 709 by a pair of bolts 712 and 716. The first steam roll adjustment member 709 has a pair of flanges and there are two first steam roll adjustment mechanisms 710 and 720 which in conjunction with bolts and nuts operating on the flanges as previously described allow the steam roll 717 to shift vertically along upper left vertical member 701. There are two first steam plate bearing members 715 with another identical member on the other side of first steam roll 717 which is not shown and serves to hold first steam roll 717 in a rotatable position. There is a first steam roll input 714 to introduce water vapor into first steam roll 717 as well as a first steam roll condensate tube 716 to remove condensed liquid from first steam roll 717.

Pile fabric 8 then travels around the outside perimeter of second steam roll 747. Second steam roll 747 is rotatably attached to upper middle horizontal support members 738 by means of a pair of bearing members 744. Bearing members 744 are attached to a second steam roll mounting plate 741 by means of bolts 743 and 748, respectively. The second steam roll mounting plate 741 is attached to a second steam roll adjustment member 739 by a pair of bolts 749 and 742. The second steam roll adjustment member 739 has a pair of flanges and there are two first steam roll adjustment mechanisms 740 and 750 which in conjunction with bolts and nuts operating on the flanges as previously described allow the second steam roll 747 to shift horizontally along upper middle horizontal support members 738. There are two second steam plate bearing members 744 with another identical member on the other side of second steam roll 747 which is not shown and serves to hold second steam roll 747 in a rotatable position. There is a second steam roll input 745 to introduce water vapor into second steam roll 747 as well as a second steam roll condensate tube 746 to remove condensed liquid from second steam roll 747.

The pile fabric 8 then goes around the outside of third steam roll 729. Third steam roll 729 is rotatably attached to upper left vertical member 701 by means of a pair of bearing members 727 that are attached to a third steam roll mounting plate 723 by means of bolts 725 and 730, respectively. The third steam roll mounting plate 723 is attached to a third steam roll adjustment member 721 by a pair of bolts 724 and 731. The third steam roll adjustment member 721 has a pair of flanges and there are two third steam roll adjustment mechanisms 722 and 732 which in conjunction with bolts and nuts operating on the flanges as previously described allow the third steam roll 729 to shift vertically along upper left vertical member 701. There are two third steam plate bearing members 727 with another identical member on the other side of third steam roll 729 which is not shown and serves to hold third steam roll 729 in a rotatable position. There is a third steam roll input 726 to introduce water vapor into third steam roll 729 as well as a third steam roll condensate tube 728 to remove condensed liquid from third steam roll 729.

Pile fabric 8 then travels around the outside perimeter of fourth steam roll 760. Fourth steam roll 760 is rotatably attached to top horizontal support members 751 by means of a pair of bearing members 757. Bearing members 757 are attached to a fourth steam roll mounting plate 754 by means of bolts 756 and 761, respectively. The fourth steam roll mounting plate 754 is attached to a fourth steam roll adjustment member 752 by a pair of bolts 755 and 762. The fourth steam roll adjustment member 752 has a pair of flanges and there are two fourth steam roll adjustment mechanisms 753 and 765 which in conjunction with bolts and nuts operating on the flanges as previously described allow the fourth steam roll 760 to shift horizontally along top horizontal support members 751. There are two fourth steam plate bearing members 757 with another identical member on the other side of fourth steam roll 760 which is not shown and serves to hold fourth steam roll 760 in a rotatable position. There is a fourth steam roll input 758 to introduce water vapor into second steam roll 760 as well as a fourth steam roll condensate tube 759 to remove condensed liquid from fourth steam roll 760.

The pile fabric 8 then travels around fifth steam roll 802 which is the primary steam roll that is used in conjunction with the brushing action. This is rotatably attached by means by a pair of bearing mechanisms 801 which are held by bolts 803 and 804 to horizontal support member 798 which has a left horizontal member 796 and a right horizontal member 797 attached thereto which connect to the underside of top horizontal member 751, respectively. There are a pair of adjustment mechanisms 805 and 806, respectively to be able to shift fifth steam roll 802 horizontally. There is also a fifth steam input 799 and steam condensate tube 800 associated with the fifth primary steam roll 802. There are two brushing mechanisms shown on the left and right of fifth steam roll 802 which are identical, but reversed.

The brushing mechanism on the left has a first housing frame 779 that is connected to a pair of pivot shafts 826 that are rotatably supported in a pair of pivot members 791. Pivot members 791 are attached to adjustment member 795 by means of bolts 792 and 793, respectfully and having an adjustment mechanism 794, as previously described for horizontal movement of the pivot shafts 826 along middle horizontal members 735.

The brushing mechanism on the right has a second housing frame 899 that is connected to a pair of pivot shafts 825 that are rotatably supported in a pair of pivot members 827. Pivot members 827 are attached to adjustment member 810 by means of bolts 828 and 829, respectfully and having an adjustment mechanism 811, as previously described for horizontal movement of the pivot shafts 825 along middle horizontal members 735.

There is a positioning bracket 788 that allows the first housing frame 779 to come back to the exact same position for the same degree of brush penetration. There is an adjustable stop 787 that is connected to the positioning bracket 788 that can be moved toward and away from the face of the positioning bracket 788 to adjust the stop of the first housing frame 779. The adjustable stop 787 will abut an eccentric cam 733 when in position. As shown on the right brushing mechanism, the eccentric cam 733 is mounted on a shaft 822 that is connected to a pulley 821 that is moved by means of an endless belt 820 that is connected to a secondary pulley 819 that is rotated by a hand crank 818 having a pin mechanism to lock the hand crank 818 into position. There is another adjustment mechanism 813 that moves secondary pulley 819 to place tension on endless belt 820. Adjustment mechanism 813 is mounted to the second housing frame 899 by a series of three bolts 814.

There is a motor 780 which drives the system having a pulley 781 and endless belt mechanism 782. This endless belt mechanism 782 drives cylindrical brush 784 by means of attached pulley 1784. Cylindrical brush 784 is rotatably attached to bearing plates 823 that are attached by means of four bolts 790. Endless belt mechanism 782 also drives a cleaning roll 783 with associated pulley 824 the removes lint and debris from the cylindrical brush 784. Cylindrical brush 784 has bristles that can be of any length and only need to contact the fabric between just barely touching the fabric to almost touching the backing of the fabric. The preferred length of bristles is 0.25 to 1.75 inches. It is preferable that these bristles are of stainless steel or of some other non-corrosive material. These bristles also can be coated. The density of the bristles depend on the effect desired and the type of pile fabric brushed. Cleaning roll 783 needs to be able to engage the bristles of cylindrical brush 784. Both cylindrical brushes 784 will engage the fabric that is passed around the outside of the fifth steam roll 802. The preferred r.p.m. of the cylindrical brushes is a range of 500 to 600 with a possible range of 0 to 3000. The pile fabric 8 will preferably pass through this invention at a rate of thirty yards per minute, however, any speed between 0 to 250 yards per minute will work.

Motor 780 is mounted to both frame 779 and 899 by means of bolts 785 and 786 and adjustment mechanism 789. Cleaning roll 783 is mounted in a adjustable bearing assembly plate 816 with a set of four inner bolts 815 and an outer slotted plate assembly 898 with another four bolts with a pair a adjustment mechanisms 778 and 812 attached thereto.

First housing frame 779 is supported by a pin member 777 and there is an air cylinder 776 that is also pivotally mounted by means of pin 775 to a support member 774. There are four bolts 809 attached to a plate which also provides support, as also shown in FIG. 9. Support member 774 is attached to bottom horizontal member 736.

There is a shock absorber shown in FIG. 9 as numeral 870 mounted by means of four bolts 808 to plate member 807 that is attached to middle horizontal member 735. This same structure is replicated on the right hand side with second housing frame 898 supported by a pin member 897 and there is an air cylinder 896 that is also pivotally mounted by means of pin 895 to a support member 894. There are four bolts 893 attached to a plate which also provides support, as also shown in FIG. 9. Support member 894 is attached to bottom horizontal member 736. There is a shock absorber shown in FIG. 9 as numeral 871 mounted by means of four bolts 817 to plate member 816 that is attached to middle horizontal member 735.

All heating and brushing mechanisms to erect pile fabric 8 are mounted on adjustable levelers 737 utilizing dual nut with threaded bolt combination. Air cylinders 176, 376, 576, and 776 have inputs 253,453, 653 and 853 and outputs 252, 452, 652 and 852, respectively. Air cylinders 296, 496, 696 and 896 have an inputs and 254, 454, 654 and 854 and outputs 255, 455, 655 and 855, respectively.

Pile fabric 8 then goes through lower idler roll 830 which is rotatably supported by pair of bearings 831 which is bolted by means of bolts 832 and 833 to adjustment member 834 having adjustment means 835 and 836 as previously described which attach to the underside of upper middle horizontal support member 738. Pile fabric 8 then exits the fourth heating and brushing mechanism 700.

All heating and brushing mechanisms to erect pile fabric 8 are mounted on adjustable levelers 737 utilizing dual nut with threaded bolt combination.

Pile fabric 8 then goes through lower idler roll 830 which is rotatably supported by pair of bearings 831 which is bolted by means of bolts 834 and 833 to adjustment member 834 having adjustment means 835 and 836 as previously described which attach to the underside of upper middle horizontal support member 738.

Figure 5:
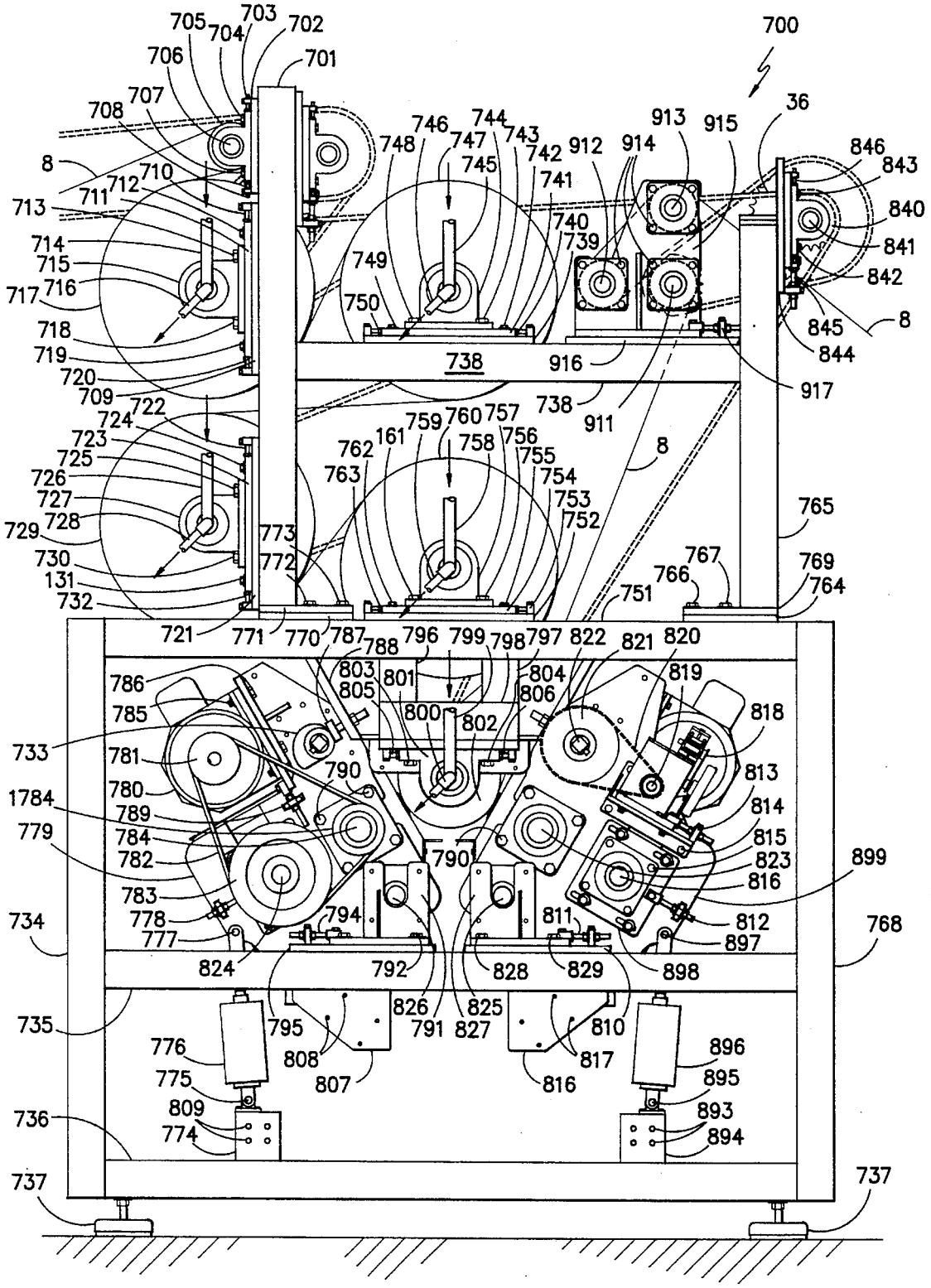
FIG. 5 is an elevational side view of a fourth mechanism for heating and brushing fabric.

The pile fabric 8 then goes through a first s-wrap roll 911, second s-wrap roll 914, third s-wrap roll 913 and then exit the fourth heating and brushing mechanism 700, as shown in FIG. 5. The s-wrap rolls 911, 914 and 913 are high friction rolls attached to bearing members to apply tension to the pile fabric 8 and are attached a frame member 915 by means of a set of four bolts 914. Frame member 915 is attached to the upper middle horizontal support members 138 by means of and adjustment plate 916 and adjustment mechanism 917, respectively to allow horizontal adjustment of the frame member 915 on the upper middle horizontal support members 138. The pile fabric is then transported to a take-off roll 48 that is rotatably mounted on a shaft and dual bearing assembly 30 that is mounted to a frame member 34 with wheels 34.

Referring now to FIG. 6, there is a main drive motor 958 which rotates steam rolls throughout the system. The main drive motor 958 is attached to a gear reduction mechanism 957 that is attached to sprocket 960. Gear reduction mechanism 957 is attached to frame member 964 that is attached to an L-shaped adjustment member 963 having an adjustment mechanism 964 as previously described. There are a pair of bolts 965 that secure gear reduction mechanism 957 to the L-shaped adjustment member 963.

There is a second sprocket 971 attached to second steam roll 547 and a chain 974 that rotatably interconnects sprocket 960 and second sprocket 971. Fixedly attached to second sprocket 971 is a secondary sprocket 973. Fixedly attached to third steam roll 549 is third sprocket 974 and fixedly attached to fourth steam roll 560 is fourth sprocket 975 and fixedly attached to fifth primary steam roll 604 is fifth sprocket 976. As shown in FIG. 4, there is a sixth sprocket 440 having a dual bearing mechanism 441 mounted on an adjustment plate 444 by two bolts 444, 443 with adjustment mechanisms 445 and 446, as previously described.

There is a seventh sprocket 977 fixedly attached to first steam roll 517 and a eighth sprocket 673 rotatably mounted to the upper right vertical members 565 with an endless chain 978 engaging and driving the seventh sprocket 977 and eighth sprocket 673. Seventh sprocket 977 has a secondary sprocket 980 that rotates therewith and eighth sprocket 673 has a secondary sprocket 674 that fixedly rotates therewith. As shown in FIGS. 4 and 9, there is a pair of bearing members 675 for rotating the combination of sprockets 673 and 674. The pair of bearing members 675 is attached to adjustment plate 678 by means of bolts 676 and 677. There are also adjustment mechanisms 679 and 680, as previously described.

For clarification as shown in FIG. 6, chain 36 engages secondary seventh sprocket 980, then secondary sprocket 973, then third sprocket 974, then fourth sprocket 975, then fifth sprocket 976 and finally sixth sprocket 640 before exiting this particular heating and brushing mechanism 500. The two free ends of chain 36 then engage sixth sprocket 440 of heating and brushing mechanism 300. This drive scheme is replicated throughout all four heating and brushing mechanisms. At the right hand side of FIG. 6, the chain from the fourth heating and brushing mechanism 500 is engaging the eighth secondary sprocket 674.

As shown on FIG. 9, closure 178 and 498 are actually enclosed in which lint is vacuumed out of the system by means of suction to 933, as shown.

Figure 8:
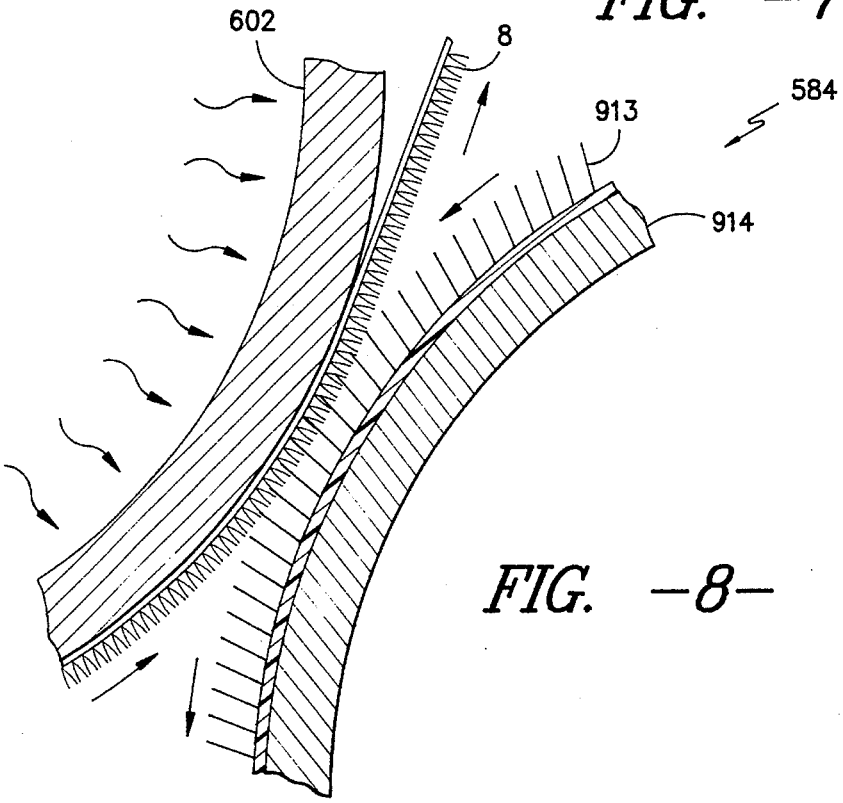
FIG. 8 is a blown-up view of a primary fifth steam roll, pile fabric and roller brush and the relationship thereof.

FIG. 8 discloses fifth primary steam roll 602 having pile fabric 8 position thereon in contact with the bristles of cylindrical roll 914 for cylindrical brush 584.

It is not intended that the scope of this invention be limited to the specific embodiment illustrated and described. Rather, it is intended that the scope of the invention be defined by the appendant claims and their equivalents.

What is claimed is:

1. A process for the continuous treatment of a web of pile fabric having a face and a back comprising the steps of:

(a) wetting said pile fabric with water to at least fifty percent saturation; and (b) simultaneously heating said pile fabric to a temperature in the range 225 to 350 degrees Fahrenheit with a heated roll and brushing said face of said pile fabric with a brush.

2. A process for the continuous treatment of a web of pile fabric having a face and a back comprising the steps of:

(a) wetting said pile fabric with water to at least fifty percent saturation; and (b) simultaneously heating said pile fabric to a temperature in the range of 225 to 350 degrees Fahrenheit with a plurality of heated rolls and brushing said face of said pile fabric with a plurality of brushes.

3. A process for the continuous treatment of a web of pile fabric having a face with a pile and a back comprising the steps of:

(a) wetting said pile fabric with water to at least fifty percent saturation; and (b) simultaneously heating said pile fabric to a temperature in the range of 225 to 350 degrees Fahrenheit with a plurality of heated rolls and brushing said face of said pile fabric with a plurality of brushes to raise said pile and a plurality of brushes to lower said pile.

4. An apparatus for the continuous treatment of a web of pile fabric having a face and back comprising of:

(a) a means for wetting said pile fabric with a liquid to at least fifty percent saturation including a tank and a plurality of rotatable nip rolls; and (b) a means for simultaneously heating said pile fabric to a temperature in the range of 225 to 350 degrees Fahrenheit and brushing said face of said fabric including a plurality of heated rolls and a means for brushing said face of said fabric.

5. An apparatus for the continuous treatment of a web of pile fabric having a face and back comprising of:

(a) a means for wetting said pile fabric with a liquid to at least fifty percent saturation; and (b) a means for Simultaneously heating said pile fabric to a temperature in the range of 225 to 350 degrees Fahrenheit and brushing said face of said fabric including a rotatable heated roll and a means for rotating said rotatable heated roll and a means for brushing said face of said fabric.

6. An apparatus according to claim 5, in which said liquid includes water.

7. An apparatus according to claim 5, in which said means for simultaneously heating said pile fabric to a temperature in the range of 225 to 350 degrees Fahrenheit and brushing said face of said fabric includes a rotatable brush and a means for rotating said rotatable brush.

8. An apparatus according to claim 7, in which said rotatable brush is attached to a cylindrical roll.

9. An apparatus according to claim 5, in which said means for simultaneously heating said pile fabric to a temperature in the range of 225 to 350 degrees Fahrenheit and brushing said face of said fabric includes a plurality of rotatable brushes and a means for rotating said plurality of rotatable brushes.

10. An apparatus according to claim 9, in which each of said rotatable brushes is attached to a corresponding cylindrical roll.

11. An apparatus for the continuous treatment of a web of pile fabric having a face and back comprising of:

(a) a means for wetting said pile fabric with a liquid to at least fifty percent saturation; and (b) a means for simultaneously heating said pile fabric to a temperature in the range of 225 to 350 degrees Fahrenheit and brushing said face of said fabric that includes a plurality of rotatable heated rolls and a means for rotating said rotatable heated rolls, and a means for brushing said face of said fabric.

12. An apparatus for the continuous treatment of a web of pile fabric having a face and back comprising of:

(a) a means for wetting said pile fabric with a liquid to at least fifty percent saturation; and (b) a means for simultaneously heating said pile fabric to a temperature in the range of 225 to 350 degrees Fahrenheit and brushing said face of said fabric including a rotatable heated roll and a means for rotating said rotatable heated roll that includes a sprocket fixedly attached to said rotatable heated roll and a means for rotating said sprocket and a means for brushing said face of said fabric.

13. An apparatus according to claim 12, in which said means for rotating said sprocket includes an endless chain that engages said sprocket and a means for moving said endless chain thereby rotating said rotatable heated roll.

14. An apparatus for the continuous treatment of a web of pile fabric having a face and back comprising of:

(a) a means for wetting said pile fabric with a liquid to at least fifty percent saturation; and (b) a means for simultaneously heating said pile fabric to a temperature in the range of 225 to 350 degrees Fahrenheit and brushing said face of said fabric that includes a plurality of rotatable heated rolls and a means for rotating said rotatable heated rolls that includes a plurality of sprockets fixedly attached to said rotatable heated rolls in corresponding relationship and a means for rotating said plurality of sprockets and a means for brushing said face of said fabric.

15. An apparatus according to claim 14, in which said means for rotating said plurality of sprockets includes an endless chain that engages each of said sprockets and a means for moving said endless chain thereby rotating said plurality of rotatable heated rolls.

16. An apparatus according to claim 14, in which said means for simultaneously heating said pile fabric to a temperature in the range of 225 to 350 degrees Fahrenheit and brushing said face of said pile fabric includes a cylindrical brush rotatably mounted to a support member and said means for positioning said means for brushing said face of said pile fabric adjacent to said pile fabric includes a hydraulic jack.

17. An apparatus for the continuous treatment of a web of pile fabric having a face and back comprising of:

(a) a means for wetting said pile fabric with a liquid to at least fifty percent saturation; and (b) a means for simultaneously heating said pile fabric to a temperature in the range of 225 to 350 degrees Fahrenheit and brushing said face of said pile fabric including a rotatable heated roll and a means for rotating said rotatable heated roll and a means for positioning said means for brushing said face of said pile fabric adjacent to said pile fabric.

18. An apparatus for the continuous treatment of a web of pile fabric having a face and back comprising of:

(a) a means for wetting said pile fabric with a liquid to at least fifty percent saturation; and (b) a means for simultaneously heating said pile fabric to a temperature in the range of 225 to 350 degrees Fahrenheit and brushing said face of said pile fabric including a plurality of heated rolls and a cylindrical brush rotatably mounted to a support member utilized in conjunction with said plurality of heated rolls and (c) a means for cleaning said means for brushing said face of said pile fabric and said means for cleaning said means for brushing said face of said pile fabric includes a rotatable cleaning brush in contact with said cylindrical brush.

* * * * *